US006646384B2

(12) United States Patent
Barry

(10) Patent No.: US 6,646,384 B2
(45) Date of Patent: Nov. 11, 2003

(54) MICROWAVE POWERED UV LAMP WITH IMPROVED RF GASKET ARRANGEMENT

(75) Inventor: Jonathan D. Barry, Frederick, MD (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 0 days.

(21) Appl. No.: 10/078,006

(22) Filed: Feb. 20, 2002

(65) Prior Publication Data

US 2003/0155870 A1 Aug. 21, 2003

(51) Int. Cl.[7] ..... H01J 23/36

(52) U.S. Cl. ..... 315/39.53; 315/39.51; 315/248

(58) Field of Search ..... 315/248, 39.3, 315/39.51, 39.53, 267, 344; 216/102, 105, 69

(56) References Cited

U.S. PATENT DOCUMENTS

| | | | | |
|---|---|---|---|---|
| 2,958,754 A | | 11/1960 | Hahn | 219/10.55 |
| 3,584,177 A | * | 6/1971 | Bucksbaum | 219/741 |
| 3,681,652 A | | 8/1972 | Domenichini et al. | 315/85 |
| 3,904,937 A | | 9/1975 | Levin | 317/120 |
| 4,431,888 A | * | 2/1984 | Simpson | 219/749 |
| 5,294,319 A | * | 3/1994 | Kaczur et al. | 204/290.03 |
| 5,407,119 A | * | 4/1995 | Churchill et al. | 228/124.5 |
| 6,031,333 A | * | 2/2000 | Simpson | 315/39 |

* cited by examiner

*Primary Examiner*—Haissa Philogene
(74) *Attorney, Agent, or Firm*—Antonelli, Terry, Stout & Kraus, LLP

(57) ABSTRACT

The present invention is a microwave excited lamp and a microwave gasket. A microwave excited lamp (10) in accordance with the invention includes at least one microwave source (12); a microwave structure (20) comprising a metallic material to which microwaves are coupled from the microwave source; the microwave structure, including a reflector (22) comprising the metallic material and containing a microwave excited bulb (24) which emits light in response to coupling of microwave power thereto from the microwave source; and at least one microwave gasket (100) which provides a microwave tight seal between a surface of the reflector and at least one other metallic part of the microwave structure with the gasket comprising the metallic material; and wherein during operation of the lamp a microwave current maxima flows on a surface of the gasket and the reflector.

51 Claims, 6 Drawing Sheets

MICROWAVE POWERED UV LAMP WITH IMPROVED RF GASKET ARRANGEMENT

BACKGROUND OF THE INVENTION

1. Field of the Invention

The present invention relates to microwave excited lamps and to microwave gaskets therein.

2. Description of the Prior Art

FIGS. 1 and 2 illustrate a schematic diagram of a prior art microwave excited lamp 10 of the type manufactured by the Assignee of the present invention. The microwave lamp 10 has a magnetron 12. The magnetron 12 is rated with maximum sustained output power of at least 1,000 watts and typically at least 2,000 watts. The magnetron 12 includes a housing 14 of a conventional design including heat radiating fins (not illustrated) thereon to dissipate heat generated therein. The magnetron 12 typically oscillates at a frequency, such as 2.45 GHz, to produce the aforementioned output power. The magnetron 12 includes an antenna 18 which radiates microwaves within a microwave structure 20. The microwaves are coupled to the UV electrodeless bulb 24 within a reflector 22 to cause the emission of UV light therefrom. The microwave structure 20 is manufactured from a metallic material, such as aluminum or stainless steel and contains the reflector 22. The reflector 22 has a curved reflective surface 23 which reflects the UV wavelengths of the light produced by the UV bulb 24 through a metallic mesh 28 to a target (not illustrated). The metallic mesh 28 contains the microwaves within the reflector 22 but is transparent to the UV rays. The microwaves are coupled into the reflector 22 by slots 30.

It should be understood that the magnetron 12 of FIG. 1 has been omitted from FIG. 2 in order to illustrate the backside surface 34 of the reflector 22 extending along the microwave structure 20 and the prior art usage of silver-plated brass wire mesh microwave gaskets 40 which provide microwave seals against aluminum structures within the microwave structure. The arcuate section 31 set off by dotted lines is a surface area where it has been discovered that at least one standing wave microwave current maxima exists during operation.

A pair of rails 32 connect the back surface 34 of the reflector 22 to opposed side walls 36 of the microwave structure 20 to provide a support structure for the reflector. The microwave structure 20 is electrically conductive and comprises aluminum. The microwaves transmitted from the antenna 18 flow on the surface 34 of the reflector 22 and through the slots 30. The microwaves are prevented from leaking below the rails 34 by the silver-plated brass wire mesh microwave gaskets 40 and outside the end walls 44 by silver-plated brass wire mesh microwave gaskets 42 which each are of identical construction, and are manufactured from multiple wire filaments. The microwave gaskets 40 provide a microwave tight seal between the back surface 34 of the reflector 22 and the opposed side walls 36 of the microwave structure 20. The microwave gaskets 42 seal the microwaves from leaking beyond the end plates 44.

The current maxima in location 31 has been discovered to occur approximately in the middle third of the microwave structure 20 therewith discussed below regarding FIG. 3. Oxidation of the silver-plated brass wire mesh gasket material occurs due to the presence of ozone, UV light, and heat during lamp operation. The progressive oxidation process increases the amount of contact resistance between the gasket and the reflector and the rails.

The gaskets 40' (new) and the gasket 40" (after use) of FIG. 3 are identical to the gasket 40 of FIG. 2 and are wire manufactured-from silver-plated brass filaments. Silver plating was chosen because of low electrical resistance. The new silver gasket 40' is not oxidized and, as a result, provides the low electrical resistance between the gasket and aluminum of the reflector 22 and the rails 32 to the substantial alternating microwave current flow occurring within the area 31 over the back surface 34 of the aluminum reflector 22, the surfaces of gasket 40, the surface of the longitudinally extending aluminum rails 32, and the surface of the opposed aluminum walls 36 of the microwave structure 20. Alternating current circulates in a loop back and forth on the surface of the aforementioned parts and causes a voltage drop across the contact resistance between the silver-plated brass wire mesh gasket 40 and the aluminum reflector 22 and the aluminum rails 32.

The silver-plated brass wire mesh gasket 40" has been used for 3,059 hours in a lamp of the design of FIGS. 1 and 2 for generating UV light. It has been discovered by the inventor that the substantial oxidation of the silver-plated brass wire mesh gasket 40" is a result of the presence of heat, ozone and UV light. It has been further discovered by the inventor that the substantial oxidation in the vicinity of the area 31 increases the electrical contact resistance inherent in the electrical contact between the dissimilar materials of the aluminum used in the manufacture of the reflector 22 and rails 32 and the silver-plated brass of the gasket 40. The increase in contact resistance caused by the oxidation of the silver plating in the vicinity of the current maxima in area 31 is so substantial that a sealing failure of the gaskets 40 and a heat related failure of the reflector 22 of FIGS. 1 and 2 occurs. The highly oxidized state of the gasket 40" produces an increased contact resistance causing localized heating at the gasket interface with the back surface 34 of the reflector 22. The heating destroys the reflector requiring both the gasket 40 and the reflector 22 to be replaced to maintain operational status of the lamp 10. The rails 32 may also be locally damaged by the heat in the vicinity of the area 31.

SUMMARY OF THE INVENTION

The present invention is an improved microwave excited lamp and gasket for use therein having a substantially longer life than the aforementioned prior art silver-plated brass wire mesh gasket and associated reflector of aluminum in electrical contact therewith. In accordance with the invention, a light reflector in a microwave excited lamp, the gasket and optionally at least one other metallic part of the microwave structure all comprise a common metallic material, such as elemental aluminum or stainless steel which substantially eliminates contact resistance. Since materials containing the same metal do not have appreciable contact resistance, the aforementioned problem of increased contact resistance caused by oxidation in the area of a current maxima inside the microwave structure which flows on the surfaces of the reflector, gasket, and at least one other part is eliminated. The metallic material used in the gasket, reflector and optionally any other parts may comprise, may consist essentially of or may consist of aluminum or stainless steel. In accordance with the invention, the reflector, microwave gasket, and optionally the at least one other part, do not have to be manufactured from identical metallic materials with it being within the scope of the invention to have different alloys comprising the metallic material, such as elemental aluminum or different alloys of stainless steel containing different percentages of ingredients.

Test results show that the failure of the prior art gasket 40" illustrated in FIG. 3 does not occur with the invention as a result of the reflector, gasket and optionally at least one other part comprising the same metallic material, such as elemental aluminum or stainless steel.

A microwave excited lamp in accordance with the invention includes a microwave source; a microwave structure including a reflector comprising a metallic material and containing a microwave excited bulb which emits light in response to coupling of microwave power thereto from the microwave source; and at least one microwave gasket which provides a microwave tight seal between a surface of the reflector and at least one other part of the microwave structure with the gasket comprising the metallic material; and wherein during operation of the lamp a microwave current maxima flows on a surface of the gasket and the reflector. Each microwave source may be rated at at least 1000 watts and may be at least 2000 watts. The reflector and the gasket may comprise, may consist essentially of, or consist of elemental aluminum or alloys thereof. The reflector and the gasket may comprise, may consist essentially of, or consist of stainless steel of different compositions. The microwave gasket may comprise wire. The reflector may be curved and have an axis extending along the microwave structure; and the microwave structure may comprise opposed parts and a pair of members extending along the reflector which are respectively joined to the opposed parts and to the reflector and for each member a pair of microwave gaskets respectively may provide a microwave tight seal between the member and an adjacent one of the opposed parts and the member and a back surface of the reflector. The opposed parts may be opposed walls of the microwave structure.

In a microwave excited lamp, including at least one microwave source, a microwave structure comprising a metallic material to which microwaves are coupled from the microwave source, the microwave structure including a reflector comprising the metallic material and containing a microwave excited bulb which emits light in response to coupling of microwave power thereto from the microwave source, and at least one microwave gasket which provides a microwave tight seal between a surface of the reflector and at least one other metallic part of the metallic microwave structure, and wherein during operation of the lamp, a microwave current maxima flows on a surface of the reflector and the gasket, a gasket in accordance with the invention includes the metallic material. Each microwave source may be rated at at least 1000 watts and may be rated at at least 2000 watts. The reflector and the gasket may comprise, consist essentially of, or consist of elemental aluminum. The reflector and the gasket may comprise, may consist essentially of, or may consist of stainless steel. The gasket may comprise wire of multiple filaments.

BRIEF DESCRIPTION OF THE DRAWINGS

FIG. 2 illustrates a top isometric view of the microwave excited lamp of

Like reference numerals identify like part throughout the drawings.

DESCRIPTION OF THE PREFERRED EMBODIMENTS

Figure 3:
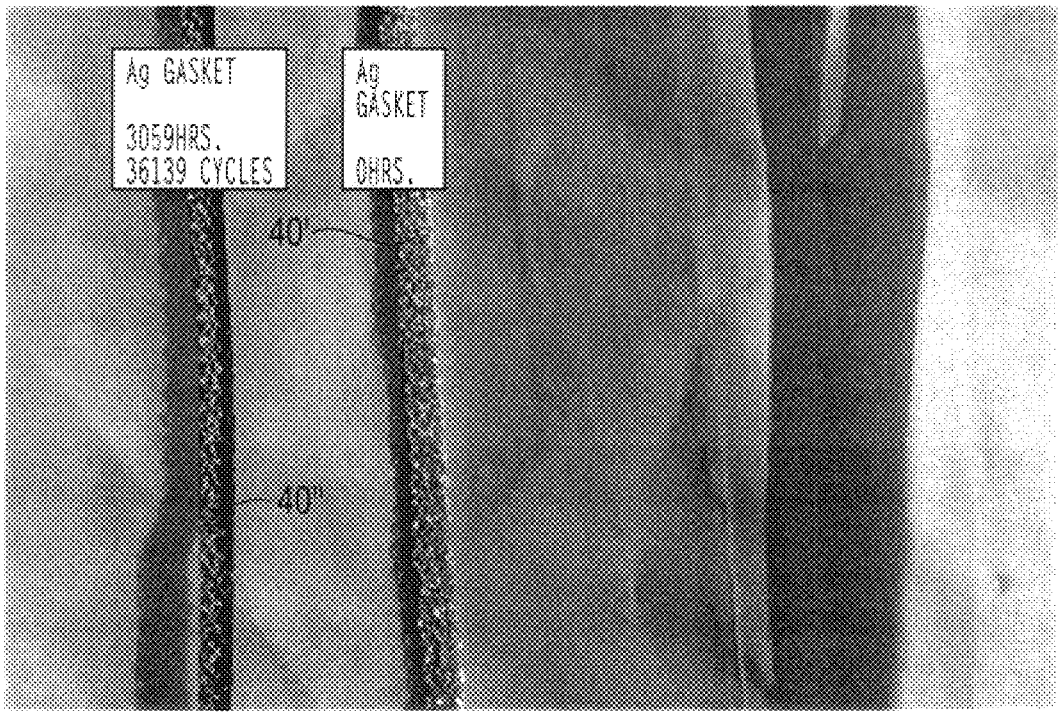
FIG. 3 (PRIOR ART)
FIG. 3 illustrates a photograph of a prior art new silver gasket and an identical silver gasket after substantial usage used in a microwave excited lamp of the design of FIGS. 1 and 2.
Figure 4:
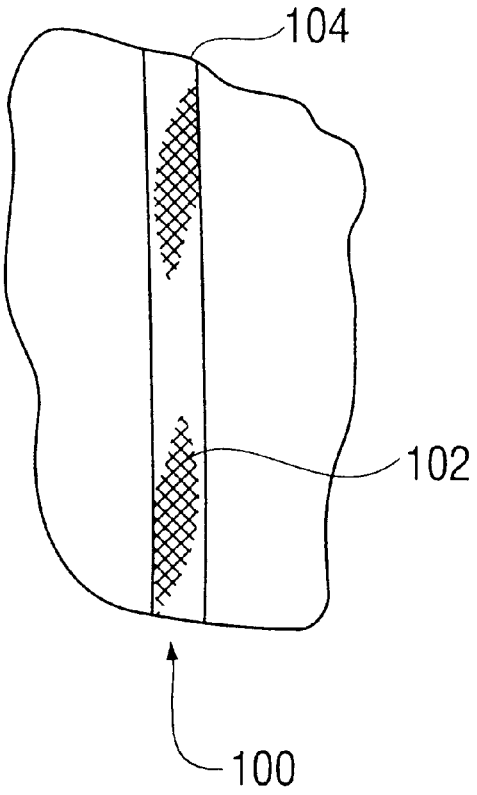
FIG. 4 illustrates a gasket in accordance with the present invention.
Figure 5:
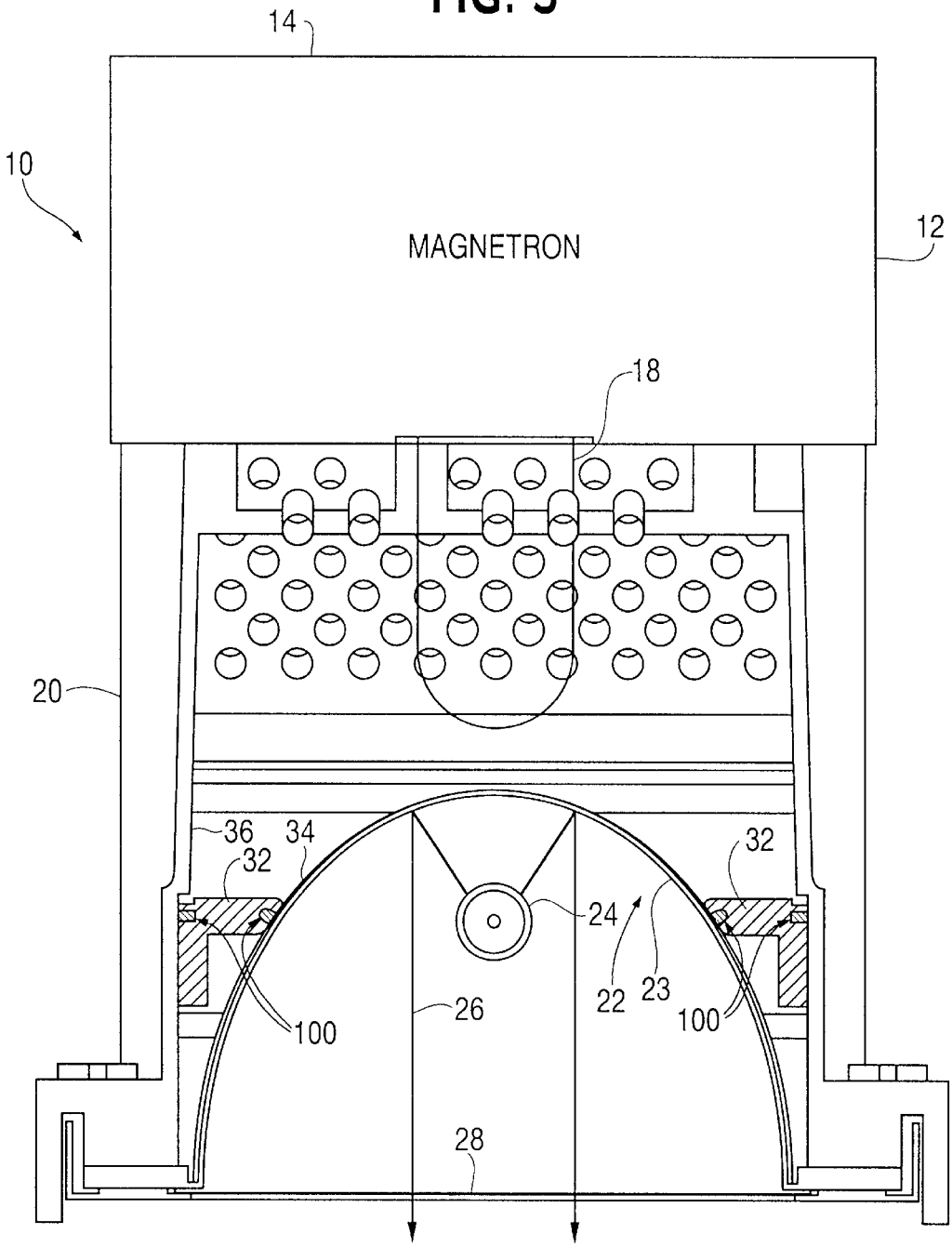
FIGS. 5 and 6 illustrate a microwave excited lamp in accordance with the present invention.
Figure 6:
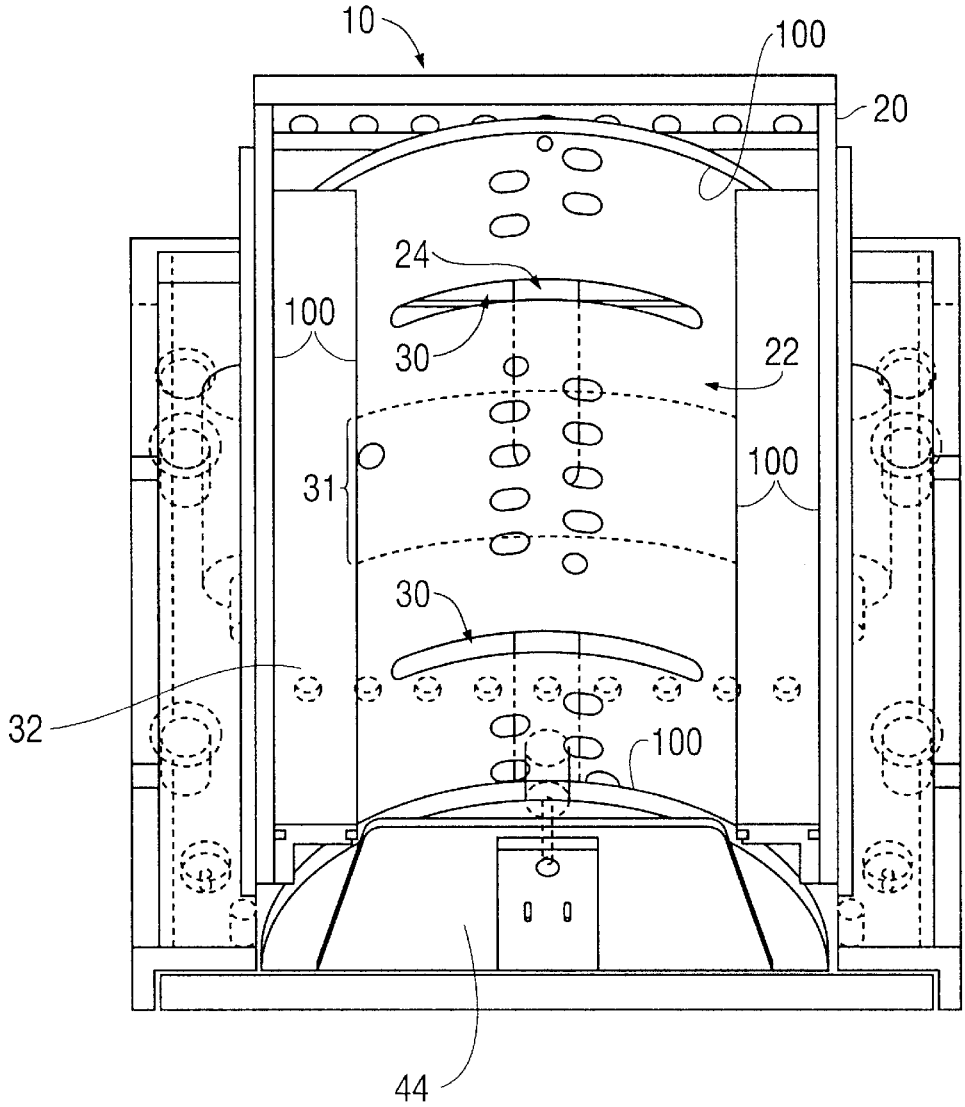

FIG. 4 illustrates an improved microwave gasket 100 in accordance with the invention for use in a microwave excited lamp including, but not limited to, the microwave excited lamp of FIGS. 5 and 6. The gasket 100 is made from a metallic material which has substantially no contact resistance, and preferably no contact resistance when in electrical contact with the reflector 22 and optionally other structures such as the rails 32. The physical construction of the gasket 100 may be the same multifilament wire structure of the prior art gasket of FIG. 3 but is not limited thereto. The multiple filaments 102 may be formed into a wire, such as rope 104, by any known process. The metal used to form the gasket 100 is also used in at least the reflector of the microwave excited lamp so as to at least substantially eliminate all contact resistance. In preferred embodiments of the invention, the gasket 100, reflector 22 and optionally, other parts of the microwave structure 20, comprise aluminum or stainless steel, consist essentially of aluminum or stainless steel or consist of aluminum or stainless steel. It should be understood that the gasket 100 of FIG. 4 may be used in diverse designs of microwave powered lamps and eliminates the problem of gasket and reflector failure of the prior art of FIG. 3 in microwave powered lamps in which a current maxima flows within the microwave structure on the surface of the gasket and the reflector which have electrical contact resistance therebetween resultant from dissimilar metals being used therein.

Figure 1:
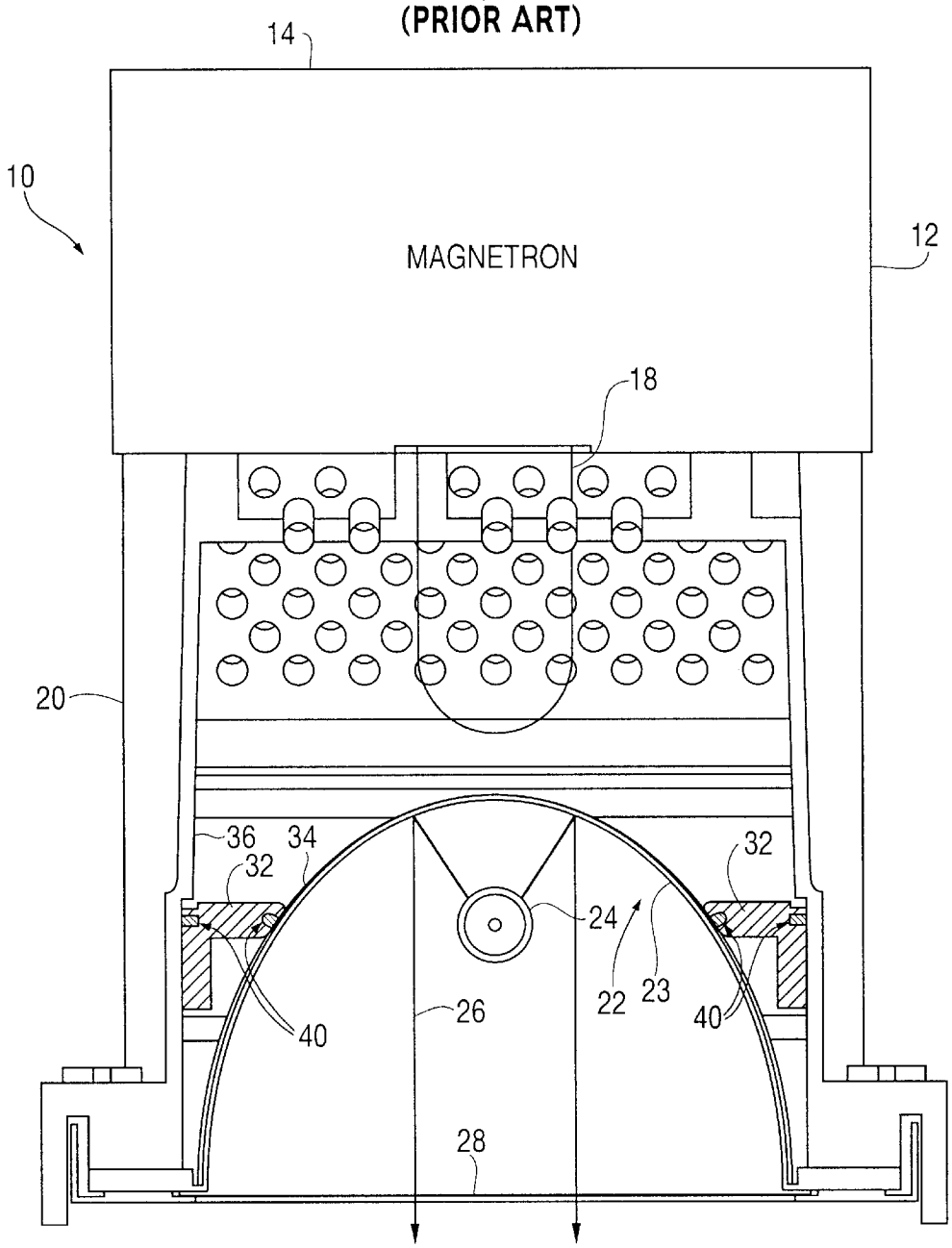
FIG. 1 (PRIOR ART)
FIG. 1 illustrates an end view of a microwave excited lamp in accordance with the prior art.
Figure 2:
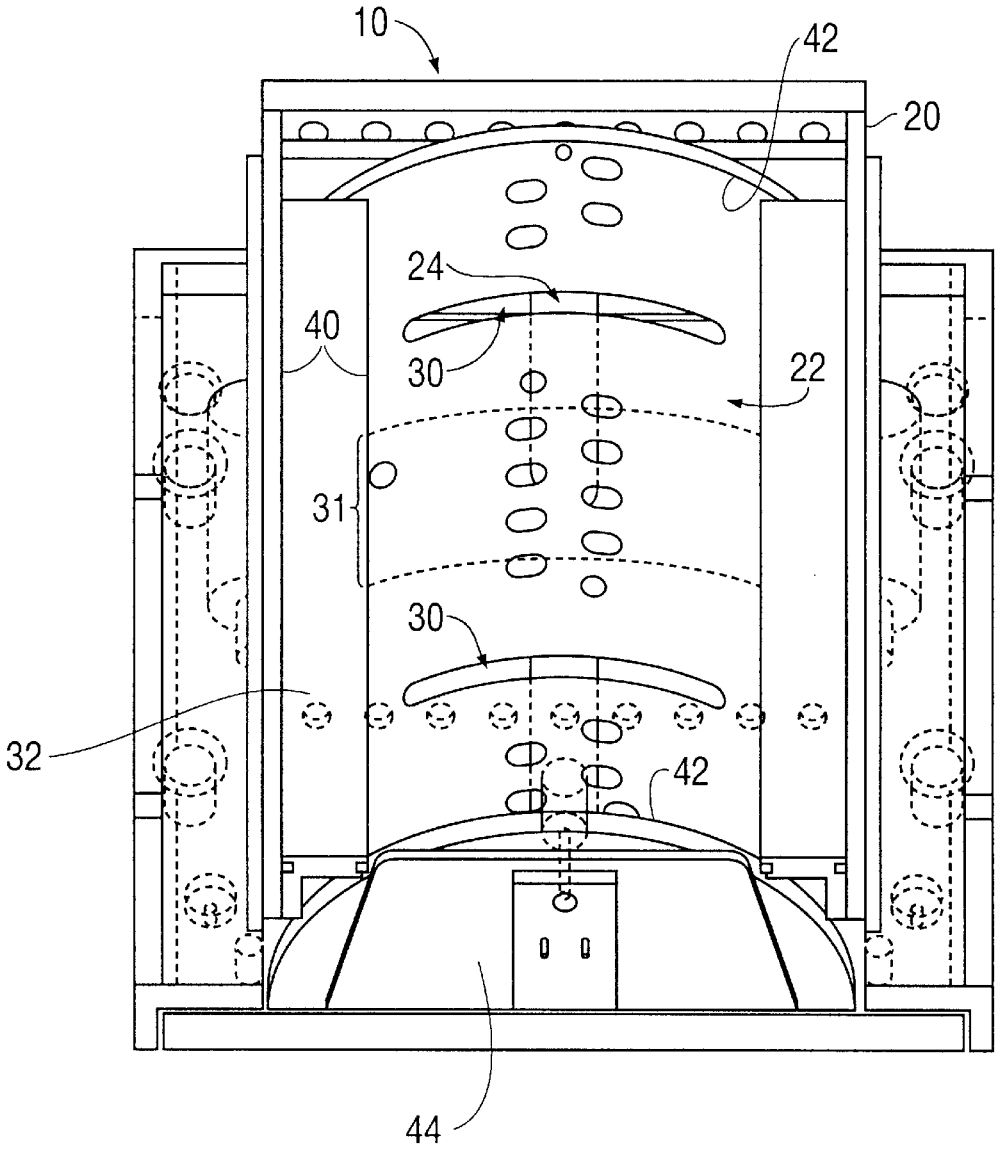
FIG. 2 (PRIOR ART)

One embodiment of a microwave excited lamp in accordance with the invention is illustrated in FIGS. 5 and 6 which is similar to the prior art of FIGS. 1 and 2 except that microwave gasket 100 of FIG. 4 replaces the gasket 40 of FIGS. 1–3.

Another embodiment of a microwave excited lamp replaces the aluminum reflector 22 and the rails 32 of FIGS. 1 and 2 with stainless steel and uses a stainless steel wire gasket 100 in place of the aluminum gasket of FIG. 3.

When each of the reflector 22, gasket 100, and optionally, at least one other metallic part in contact with the gasket, are all manufactured from the same material, the substantial elimination of contact resistance extends the life of the gasket. As stated above, the present invention is based upon the discovery that electrical contact resistance in area 31 where a current maxima occurs between dissimilar materials from which the gasket 40 and at least the reflector 22 and optionally at least one other part are manufactured in the presence of ozone, heat, and/or UV light, increase oxidation which increases contact resistance. Ultimately, the contact resistance is so high that current flow cannot be sustained properly, destroying at least the reflector 22 adjacent to the longitudinal dimension of the current maxima 31 along the gasket and also possibly, the rails 32. The prior art's necessary replacement of the reflector 22 and the gasket 40 at substantial cost to the operator of the microwave excited lamp is eliminated by the invention.

Figure 7:
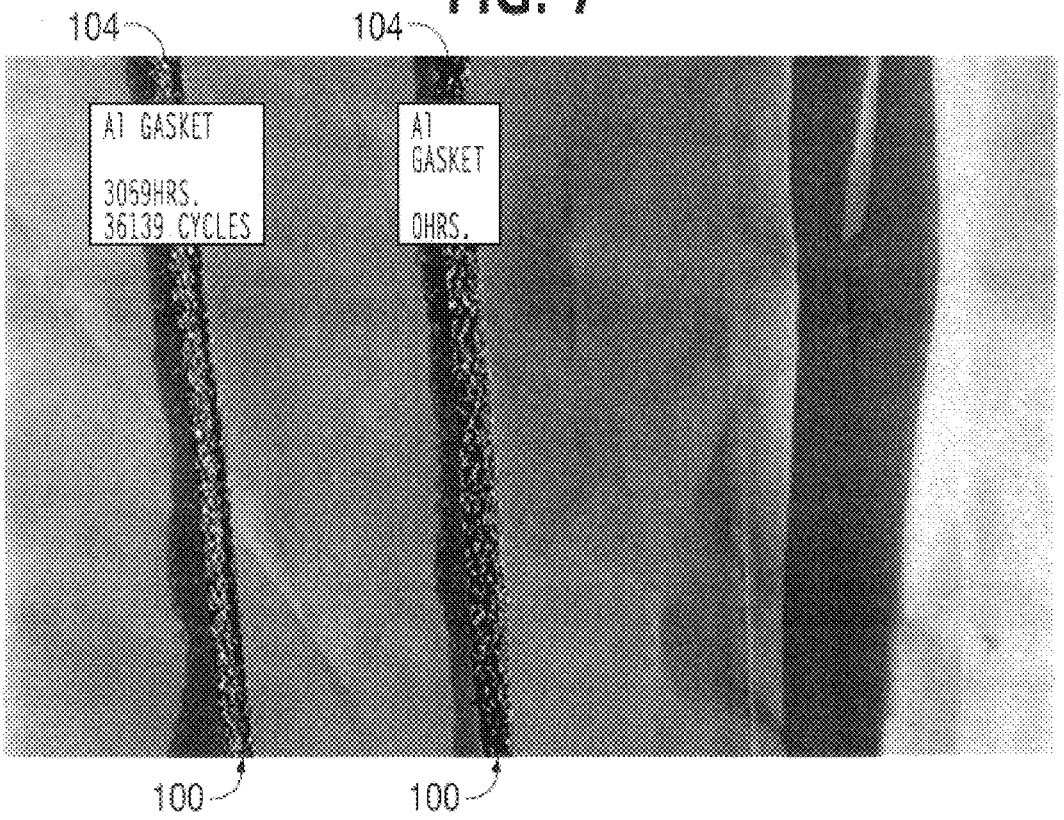
FIG. 7 illustrates photographs of a new and a tested gasket in accordance with the present invention.

FIG. 7 illustrates photographs of a wire microwave gasket 100 in accordance with the invention which is manufactured from elemental aluminum. Both the new right-hand aluminum gasket 100 and the left-hand used gasket 100 after substantial use are shiny and not substantially oxidized. After 3,059 hours of use with 36,136 cycles in the microwave excited lamp of the same design as FIGS. 5 and 6, the gasket 100 and the reflector 22 are still operational. Therefore, it is seen that the invention eliminates premature failure of the aluminum reflector 22 and silver gasket 22 of FIG. 3.

The preferred metallic material comprising the gasket, reflector and optionally at least one other part of the microwave structure 20, is elemental aluminum in view of its relatively low cost, light weight, high electrical conductivity and resistance to corrosion and oxidation. When a current maxima flows within the microwave structure 20, the premature failure of the prior art does not occur in view of the reflector 22, at least one optional part of the microwave structure 20 and the gasket 100 either comprising, consisting essentially of, or consisting of elemental aluminum.

While the invention has been described in terms of its preferred embodiments, it should be understood that numerous modifications may be made thereto without departing from the spirit and scope of the present invention. It is intended that all such modifications fall within the scope of the appended claims.

What is claimed is:

1. A microwave excited lamp comprising:

a microwave source;

a microwave structure including a reflector comprising a metallic material and containing a microwave excited bulb which emits light in response to coupling of microwave power thereto from the microwave source; and at least one microwave gasket which provides a microwave tight seal between a surface of the reflector and at least one other part of the microwave structure with the gasket comprising the metallic material; and wherein during operation of the lamp a microwave current maxima flows on a surface of the gasket and the reflector.

2. A microwave excited lamp in accordance with claim 1 wherein:

each microwave source is rated at at least 1000 watts.

3. A microwave excited lamp in accordance with claim 2 wherein:

each microwave source is rated at at least 2000 watts.

4. A microwave excited lamp in accordance with claim 1 wherein:

the reflector and the gasket comprise at least elemental aluminum.

5. A microwave excited lamp in accordance with claim 4 wherein:

the reflector and the gasket consist essentially of elemental aluminum.

6. A microwave excited lamp in accordance with claim 5 wherein:

the reflector and the gasket consist of elemental aluminum.

7. A microwave excited lamp in accordance with claim 2 wherein:

the reflector and the gasket comprise at least elemental aluminum.

8. A microwave excited lamp in accordance with claim 7 wherein:

the reflector and the gasket consist essentially of elemental aluminum.

9. A microwave excited lamp in accordance with claim 8 wherein:

the reflector and the gasket consist of elemental aluminum.

10. A microwave excited lamp in accordance with claim 3 wherein:

the reflector and the gasket comprise at least elemental aluminum.

11. A microwave excited lamp in accordance with claim 10 wherein:

the reflector and the gasket consist essentially of elemental aluminum.

12. A microwave excited lamp in accordance with claim 11 wherein:

the reflector and the gasket consist of elemental aluminum.

13. A microwave excited lamp in accordance with claim 1 wherein:

the reflector and the gasket comprise stainless steel.

14. A microwave excited lamp in accordance with claim 13 wherein:

the reflector and the gasket consist essentially of stainless steel.

15. A microwave excited lamp in accordance with claim 14 wherein:

the reflector and the gasket consist of stainless steel.

16. A microwave excited lamp in accordance with claim 2 wherein:

the reflector and the gasket comprise stainless steel.

17. A microwave excited lamp in accordance with claim 16 wherein:

the reflector and the gasket consist essentially of stainless steel.

18. A microwave excited lamp in accordance with claim 17 wherein:

the reflector and the gasket consist of stainless steel.

19. A microwave excited lamp in accordance with claim 3 wherein:

the reflector and the gasket comprise stainless steel.

20. A microwave excited lamp in accordance with claim 19 wherein:

the reflector and the gasket consist essentially of stainless steel.

21. A microwave excited lamp in accordance with claim 20 wherein:

the reflector and the gasket consist of stainless steel.

22. A microwave excited lamp in accordance with claim 1 wherein:

the microwave gasket comprises wire.

23. A microwave excited lamp in accordance with claim 2 wherein:

the microwave gasket comprises wire.

24. A microwave excited lamp in accordance with claim 3 wherein:

the microwave gasket comprises wire.

25. A microwave excited lamp in accordance with claim 4 wherein:

the microwave gasket comprises wire.

26. A microwave excited lamp in accordance with claim 5 wherein:

the microwave gasket comprises wire.

27. A microwave excited lamp in accordance with claim 6 wherein:

the microwave gasket comprises wire.

28. A microwave excited lamp in accordance with claim 13 wherein:

the microwave gasket comprises wire.

29. A microwave excited lamp in accordance with claim 14 wherein:

the microwave gasket comprises wire.

30. A microwave excited lamp in accordance with claim 15 wherein:

the microwave gasket comprises wire.

31. A microwave excited lamp in accordance with claim 1 wherein:

the reflector is curved and has an axis extending along the microwave structure; and the microwave structure comprises opposed parts and a pair of members extending along the reflector which are respectively joined to the opposed parts and to the reflector and for each member a pair of microwave gaskets respectively provide a microwave tight seal between the member and an adjacent one of the opposed parts and the member and a back surface of the reflector.

32. A microwave excited lamp in accordance with claim 31 wherein:

the opposed parts are opposed walls of the microwave structure.

33. A microwave excited lamp in accordance with claim 2 wherein:

the reflector is curved and has an axis extending along the microwave structure; and the microwave structure comprises opposed parts and a pair of members extending along the reflector which are respectively joined to the opposed parts and to the reflector and for each member a pair of microwave gaskets respectively provide a microwave tight seal between the member and an adjacent one of the opposed parts and the member and a back surface of the reflector.

34. A microwave excited lamp in accordance with claim 3 wherein:

the reflector is curved and has an axis extending along the microwave structure; and the microwave structure comprises opposed parts and a pair of members extending along the reflector which are respectively joined to the opposed parts and to the reflector and for each member a pair of microwave gaskets respectively provide a microwave tight seal between the member and an adjacent one of the opposed parts and the member and a back surface of the reflector.

35. A microwave excited lamp in accordance with claim 4 wherein:

the reflector is curved and has an axis extending along the microwave structure; and the microwave structure comprises opposed parts and a pair of members extending along the reflector which are respectively joined to the opposed parts and to the reflector and for each member a pair of microwave gaskets respectively provide a microwave tight seal between the member and an adjacent one of the opposed parts and the member and a back surface of the reflector.

36. A microwave excited lamp in accordance with claim 5 wherein:

the reflector is curved and has an axis extending along the microwave structure; and the microwave structure comprises opposed parts and a pair of members extending along the reflector which are respectively joined to the opposed parts and to the reflector and for each member a pair of microwave gaskets respectively provide a microwave tight seal between the member and an adjacent one of the opposed parts and the member and a back surface of the reflector.

37. A microwave excited lamp in accordance with claim 6 wherein:

the reflector is curved and has an axis extending along the microwave structure; and the microwave structure comprises opposed parts and a pair of members extending along the reflector which are respectively joined to the opposed parts and to the reflector and for each member a pair of microwave gaskets respectively provide a microwave tight seal between the member and an adjacent one of the opposed parts and the member and a back surface of the reflector.

38. A microwave excited lamp in accordance with claim 13 wherein:

the reflector is curved and has an axis extending along the microwave structure; and the microwave structure comprises opposed parts and a pair of members extending along the reflector which are respectively joined to the opposed parts and to the reflector and for each member a pair of microwave gaskets respectively provide a microwave tight seal between the member and an adjacent one of the opposed parts and the member and a back surface of the reflector.

39. A microwave excited lamp in accordance with claim 14 wherein:

the reflector is curved and has an axis extending along the microwave structure; and the microwave structure comprises opposed parts and a pair of members extending along the reflector which are respectively joined to the opposed parts and to the reflector and for each member a pair of microwave gaskets respectively provide a microwave tight seal between the member and an adjacent one of the opposed parts and the member and a back surface of the reflector.

40. A microwave excited lamp in accordance with claim 15 wherein:

the reflector is curved and has an axis extending along the microwave structure; and the microwave structure comprises opposed parts and a pair of members extending along the reflector which are respectively joined to the opposed parts and to the reflector and for each member a pair of microwave gaskets respectively provide a microwave tight seal between the member and an adjacent one of the opposed parts and the member and a back surface of the reflector.

41. In a microwave excited lamp including at least one microwave source, a microwave structure comprising a metallic material to which microwaves are coupled from the microwave source, the microwave structure including a reflector comprising the metallic material and containing a microwave excited bulb which emits light in response to coupling of microwave power thereto from the microwave source, and at least one microwave gasket which provides a microwave tight seal between a surface of the reflector and at least one other metallic part of the metallic microwave structure, and wherein during operation of the lamp a microwave current maxima flows on a surface of the reflector and the gasket, the gasket comprising:

the metallic material.

42. A gasket in accordance with claim 41 wherein:

each microwave source is rated at at least 1000 watts.

43. A gasket in accordance with claim 42 wherein:

each microwave source is rated at at least 2000 watts.

44. A gasket in accordance with claim 41 wherein:

the reflector and the gasket comprise at least elemental aluminum.

45. A gasket in accordance with claim 44 wherein:

the reflector and the gasket consists essentially of elemental aluminum.

46. A gasket in accordance with claim 44 wherein:

the reflector and the gasket consists of elemental aluminum.

47. A gasket in accordance with claim 41 wherein:

the reflector and the gasket comprise stainless steel.

48. A gasket in accordance with claim 47 wherein:

the reflector and the gasket consist essentially of stainless steel.

49. A gasket in accordance with claim 48 wherein:

the reflector and the gasket consist of stainless steel.

50. A gasket in accordance with claim 41 wherein:

the gasket comprises wire.

51. A gasket in accordance with claim 50 wherein:

the wire comprises multiple filaments.

* * * * *